United States Patent [19]

Frezza

[11] 4,053,151

[45] Oct. 11, 1977

[54] HIGH SPEED FABRIC FOLDER

[75] Inventor: Robert Frezza, Carle Place, N.Y.

[73] Assignee: Samcoe Holding Corporation, Woodside, N.Y.

[21] Appl. No.: 679,889

[22] Filed: Apr. 26, 1976

[51] Int. Cl.[2] ..... B65H 45/20

[52] U.S. Cl. ..... 270/79; 270/69

[58] Field of Search ..... 270/61 F, 79, 69; 226/119; 19/160, 163

[56] References Cited

U.S. PATENT DOCUMENTS

| | | | |
|---|---|---|---|
| 1,858,073 | 5/1932 | Cole | 270/79 |
| 3,170,685 | 2/1965 | Biggar | 270/69 |
| 3,195,883 | 7/1965 | Southwell | 270/79 |

*Primary Examiner*—Edgar S. Burr
*Assistant Examiner*—A. Heinz
*Attorney, Agent, or Firm*—Mandeville and Schweitzer

[57] ABSTRACT

The disclosure is directed to apparatus for folding processed fabric. It is particularly useful for, although not necessarily limited to, the folding of processed tubular knitted fabric. The folder is positioned at the discharge end of a fabric processing line, and is arranged to convey the fabric, moving at relatively high speed, to a discharge point directly above a folding platform. The fabric is then directed downward between guides, which oscillate back and forth over the folding platform, to lay the fabric in successive layers of substantially uniform length. A significant feature of the invention relates to the construction of the oscillating guide member to accommodate passage of the fabric, moving downward at relatively high speeds while the oscillating guide is moving forward and backward at relatively high speed. The guide is constructed of opposed, relatively large panels, extending across the full width of the fabric and forming a gradually converging path, leading to discharge rollers at the lower end of the folding guide. The panels are air permeable over their entire working areas, so as to provide for a general but low velocity flow of air outward from the face of the panel. This serves to provide a cushion, minimizing contact between the fabric and the rapidly oscillating guide panels, such that the downward movement of the fabric is uninhibited.

7 Claims, 6 Drawing Figures

HIGH SPEED FABRIC FOLDER

BACKGROUND AND SUMMARY OF THE INVENTION

In the processing of tubular knitted and other types of fabrics, there is a continuing trend toward processing at higher speeds, for greater operating efficiency. In the processing of tubular knitted fabrics, for example, there have been important improvements made in the rate of speed at which the fabric may be steamed and calendered, as reflected in the Frezza U.S. Pat. No. 3,875,624. As processing speeds have increased, some difficulties have been experienced in the subsequent gathering of the processed fabric. Where the fabric is to be gathered in roll form, the higher operating speeds are accommodated by employing improved arrangements for removing of filled rolls and restarting of winding of a new roll, as for example set forth in the Frezza U.S. Pat. Nos. 3,941,326 and 3,944,149. However, where the fabric is to be gathered by folding, different kinds of problems are presented by high speed operation.

In a typical fabric folder, the fabric is directed through a fabric guide, which may include a pair of closely spaced, oppositely rotating rollers. The fabric guide is oscillated back and forth at controlled speed, above a receiving platform, causing the fabric to be deposited in successive layers of substantially uniform length.

Where folding is carried out at conventional, relatively low speeds (typically on the order of 30–45 yards per minute) conventional folding equipment functions effectively. However, as speeds are increased to fifty yards per minute and above, significant problems begin to arise as a result of the necessity of moving a broad expanse of fabric laterally, in a direction substantially normal to its principal plane. When the oscillating guide reverses directions and accelerates, the broad expanse of fabric tends to become "plastered" against one side of the guide, interferring with the free downward movement of the fabric under gravity. Where this downward movement is required to occur at high speeds, even minor inhibiting of fabric movement can have a significant and undesirable effect on the folding operation, resulting in unacceptable variation in the length of individual folded layers and other problems.

In accordance with one of the significant aspects of this invention, the oscillating guide means is provided in the form of a pair of opposed panels, constructed in permeable form and joined to a plenum chamber containing air under low pressure. During operation of the folder, air is constantly flowing at low velocity through the front faces of the opposed panels. In general, the air flowing through the panels serves to provide a cushion effect, and is not utilized to impel the fabric in a downward direction. As the fabric guide oscillates back and forth, one or the other of the opposed panels functions to "push" the fabric broad side over the folding area. By reason of the cushion of air issuing from the front face of the panels, the fabric is prevented from actually contacting the panels, at least to any substantial extent. With the system of the present invention, fabric is reliably discharged from the lower end of the folding guide at a highly uniform rate, even at extremely high rates of speed. For example, whereas conventional folding equipment is largely limited to speeds of well under 50 yards per minute, the method and apparatus of the present invention enable fabric to be folded at a rate of eighty and sometimes even one hundred yards per minute.

PRIOR ART OF INTEREST

U.S. Pat. Nos. 3,668,867 and 3,747,162 relate to techniques for high speed folding of webs, by means of appropriate control and direction of air jets. This is to be contrasted to the system of the present invention, in which air is released in a low velocity, area flow and serves to provide a cushion or bearing for the fabric, rather than to deflect and displace the fabric.

For a more complete understanding of the above and other features and advantages of the invention, reference should be made to the following detailed description of a preferred embodiment and to the accompanying drawings.

DESCRIPTION OF A PREFERRED EMBODIMENT OF THE INVENTION

Figure 1:
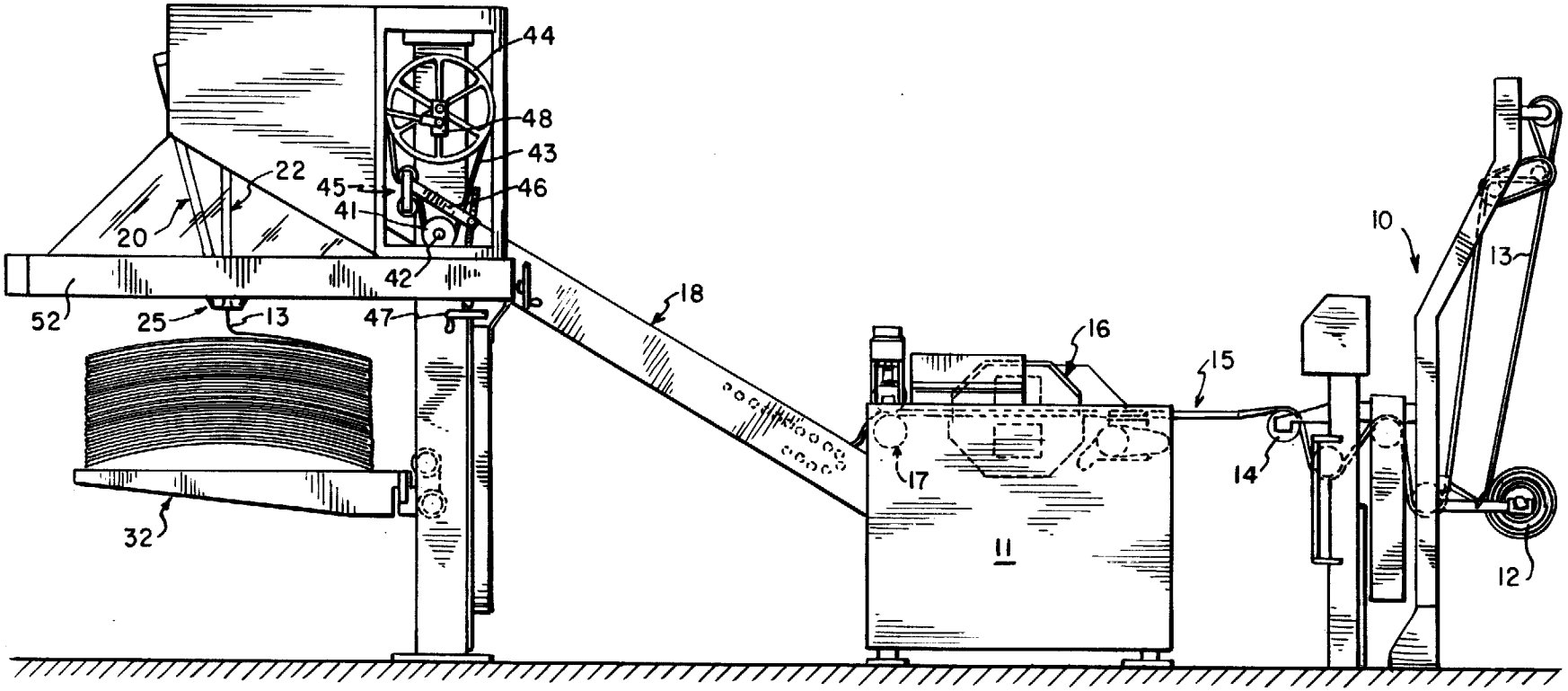
FIG. 1 is an elevational view of a fabric finishing system, including a fabric supply stand, a high speed calender, a conveyor, and a folder section, with the folder incorporating the features and advantages of the invention.

Referring now to the drawings, and initially to FIG. 1 thereof, the reference numeral 10 designates generally a supply stand furnishing tubular knitted fabric or the like to a finishing calender 11. A roll of unprocessed fabric 12 is supported in the supply stand, and a web 13 is drawn therefrom, about a series of guiding and tensioning rollers, being finally discharged over an exit guide roller 14. The fabric then advances over a spreader section 15, through a steamer section 16 and thence through calender rolls 17. The calender section 11 may be generally in accordance with the teachings of the beforementioned Frezza patents and forms no part of the present invention. In general, however, the calender section 11 is designed to process the fabric web 13 at substantially greater speeds than previously considered conventional, typically in excess of 50 yards per minute and possibly as high as 100 yards per minute.

After being discharged from the calender section 11, the fabric is advanced by an inclined slat conveyor 18, which directs the fabric web into the folding section.

Figure 4A:
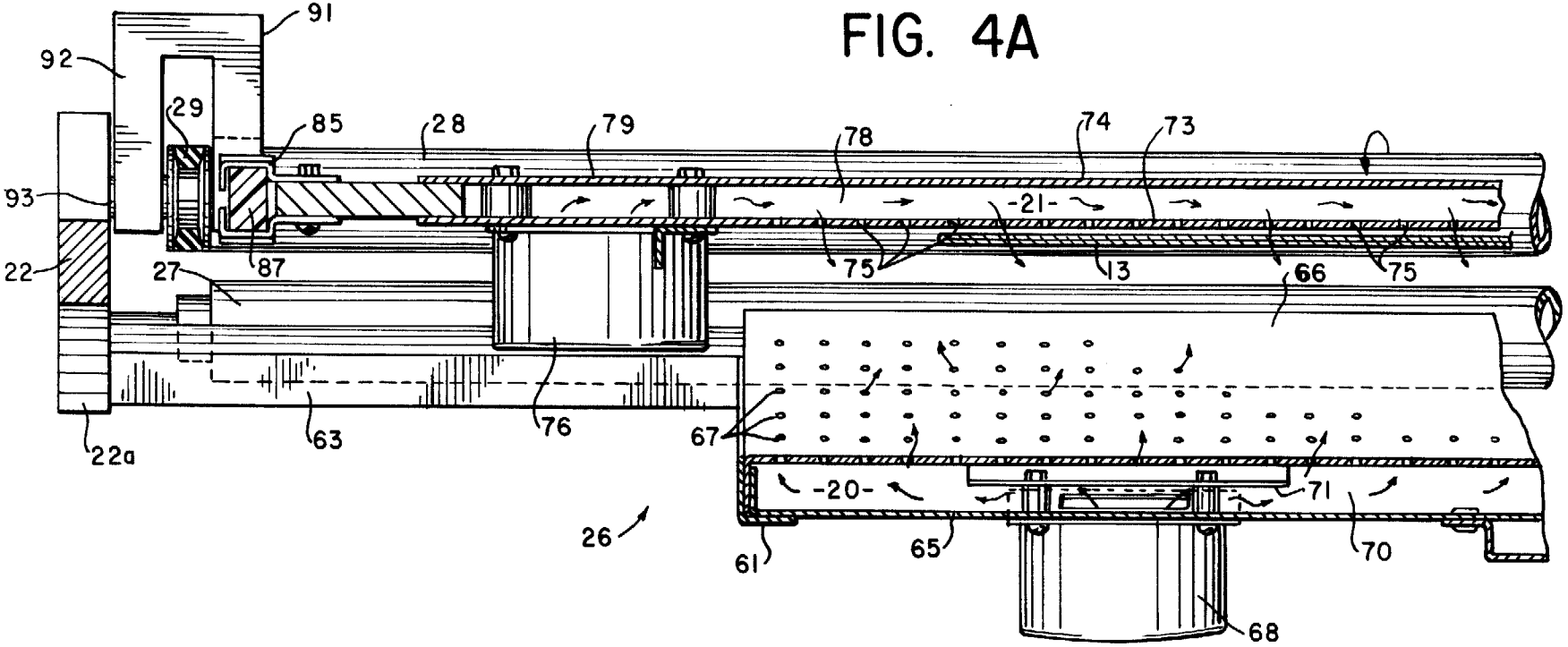
FIGS. 4A–4B, taken together, constitute an enlarged, fragmentary cross sectional view as taken generally on lines 4A,B—4A,B of FIG. 2.
Figure 4B:
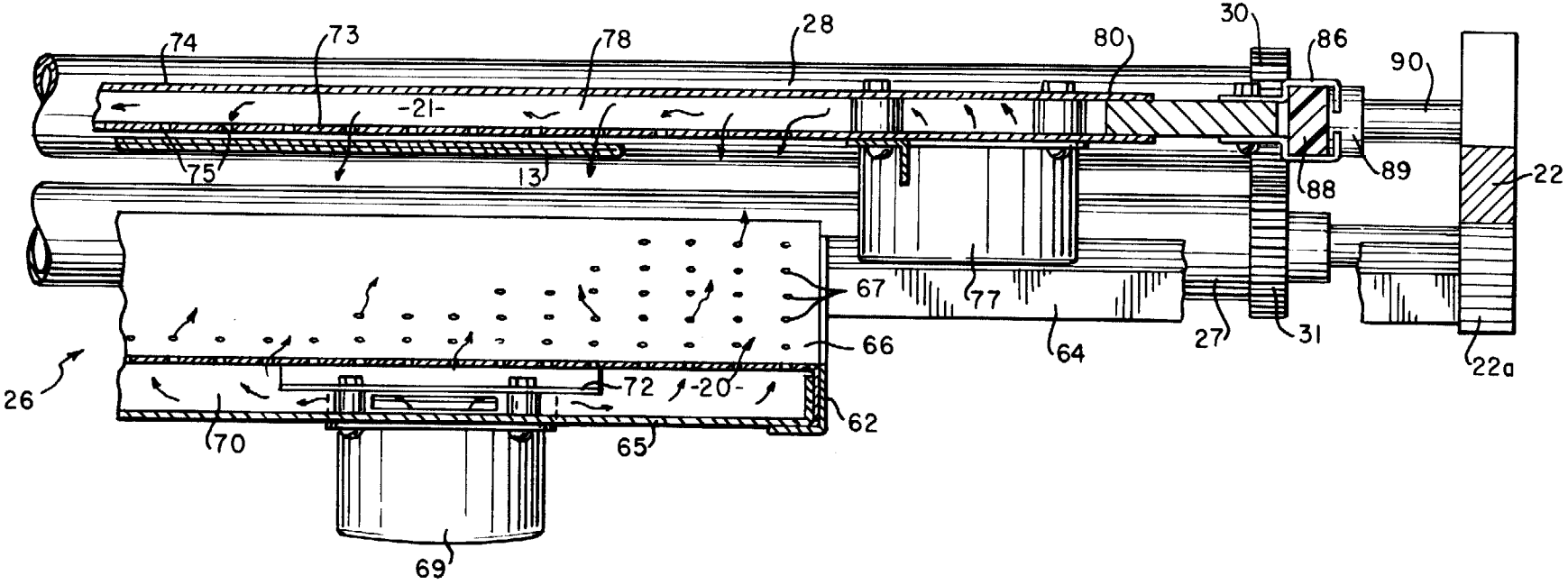

At the upper end of the slat conveyor 18, the fabric is discharged from the conveyor and falls by gravity between folding guide panel assemblies 20, 21 of a folding guide 26. One guide panel assembly 20 is suspended from a pair of arms 22 pivoted on a shaft 23 journaled high in the machine frame 24, while the other guide panel is suspended from brackets 81, 82 pivoted about a lower axis, on a conveyor drive shaft 35. By means to be described, the guide panel assemblies 20, 21 are oscillated back and forth, pivoting around the respective axis of the shafts 23, 35, such that the lower or discharge end 25 of the folding guide moves substantially at the speed of the fabric. A pair of fabric discharge rollers 27, 28 are mounted for rotation at the lower end of the folding guide, by means of brackets 22*a* carried by the pivot arms 22. One of the rollers 28 is driven by a belt 29 (FIG. 4A) while the second roller 27 is driven from the first by gears 30, 31 (FIG. 4B).

The folding guide 26 is arraned to be oscillated back and forth, pivoting about the axis of the shafts 23, 35, above a folding platform 32, laying the fabric alternately back and forth in successive layers on the platform. By appropriate means, not here described, the platform 32 is arranged to be initially set at a position of maximum elevation, a predetermined distance below the discharge end 25 of the folding guide. As successive layers of fabric are laid upon the platform during a folding operation, the platform 32 is gradually and progressively lowered, such that the uppermost layer of fabric is always approximately at the desired, predetermined distance below the folding guide.

Figure 3A:
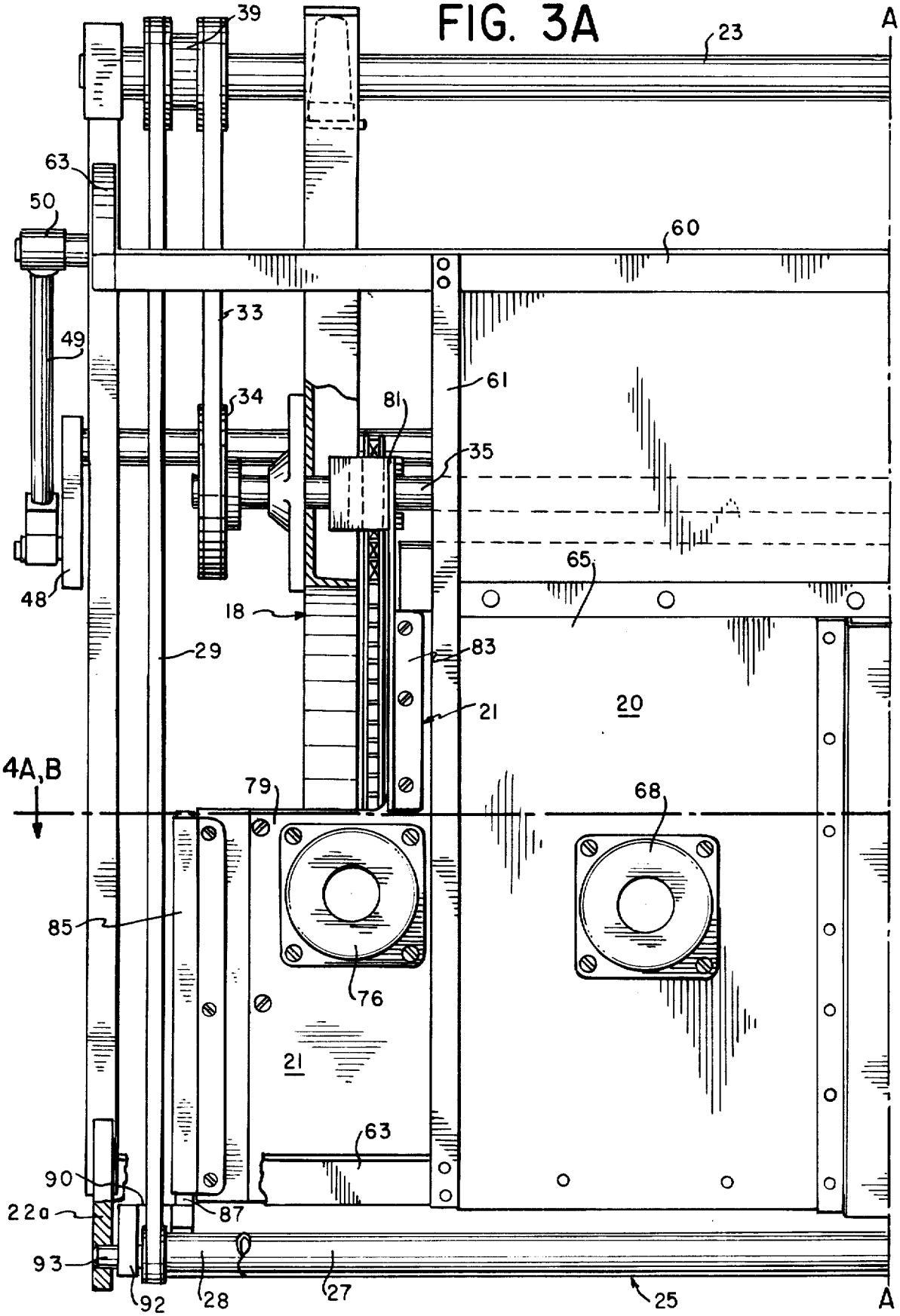
FIGS. 3A–3B, taken together, constitute an enlarged, fragmentary elevational view of the folder guide, as taken generally on lines 3A,B—3A,B of FIG. 2.
Figure 3B:
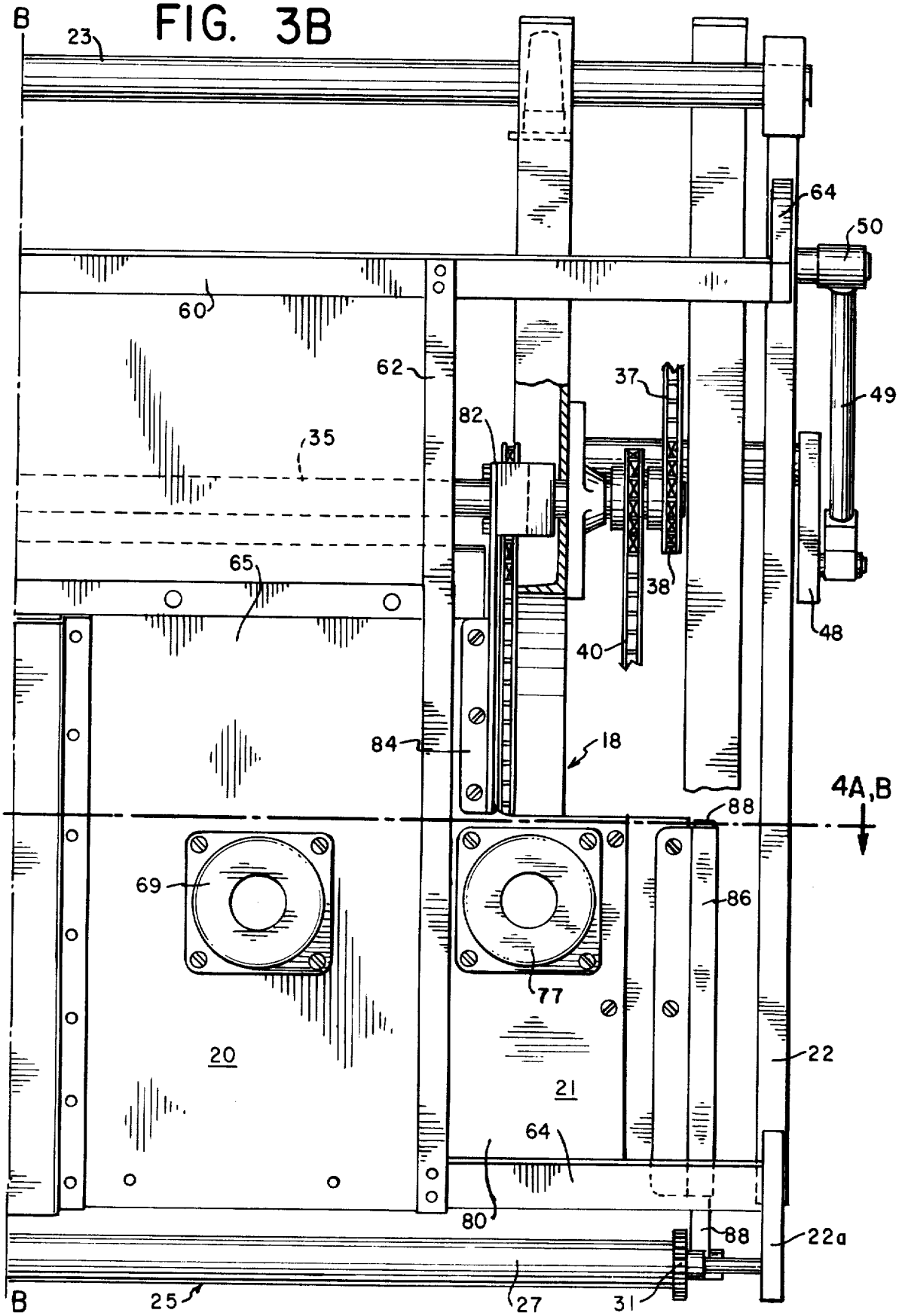

Rotation of the discharge guide rollers 27, 28 is approximately synchronized with the speed of the slat conveyor 18, and this is conveniently accomplished by means of belts 33, 29 (FIG. 3A). The belt 33 is driven from a pulley 34 carried by the conveyor drive shaft 35. This shaft 35 is in turn driven by a variable speed motor 36 through a chain 37 and sprocket 38. In the illustrated arrangement, the belt 33 drives a sheave 39 journaled on the upper pivot shaft 23 for the folding guide. The sheave 39 has a double set of grooves, one of which drives the belt 29, which extends from the sheave 39 all the way down to the belt driven roller 28.

As will be appreciated, not only are the discharge rollers 27, 28 desirably driven at a predetermined speed, corresponding to the rate of discharge of the fabric from the conveyor, but the oscillating excursions of the folding guide must also take place at a rate of speed consistent with the discharge rate of the fabric. To accommodate this, while at the same time providing for a limited range of adjustment of the folding guide excursion, provisions are made for adjustably changing the throw or excursion of the folding guide and simultaneously correspondingly increasing or decreasing the frequency of oscillation, relative to conveyor discharge speed, so that the overall oscillating speed of the discharge end remains substantially constant. Thus, a chain 40, driven from the conveyor drive shaft 33, drives a variable sheave 41 mounted on a shaft 42 journaled in the machine frame. The variable pulley 41 drives a belt 43, which in turn drives a large diameter sheave 44. A tension wheel assembly 45 operated by a lever 46 and hand crank 47, changes the tension in the belt 43, adjusting the effective diameter of the variable sheave 41 and thereby changing the effective drive ratio of the sheaves 41, 44. The sheave 44 is mounted on a shaft 44*a* which carries adjustable crank arms 48 at each end. The arms 48 are joined with the folding guide 26 by connecting rods 49, the connecting rods being pivoted to arms 22 of the folding guide at 50. By adjusting the drive ends 51 of the connecting rods radially inward or outward, the amplitude of excursion of the folding guide, for each revolution of the large sheave 44, may be adjusted. When such an adjustment is made, a compensating adjustment of the speed ratio is made by means of the hand crank 47, so that the linear rate of travel of the discharge end 25 of the folding guide remains substantially constant.

Figure 2:
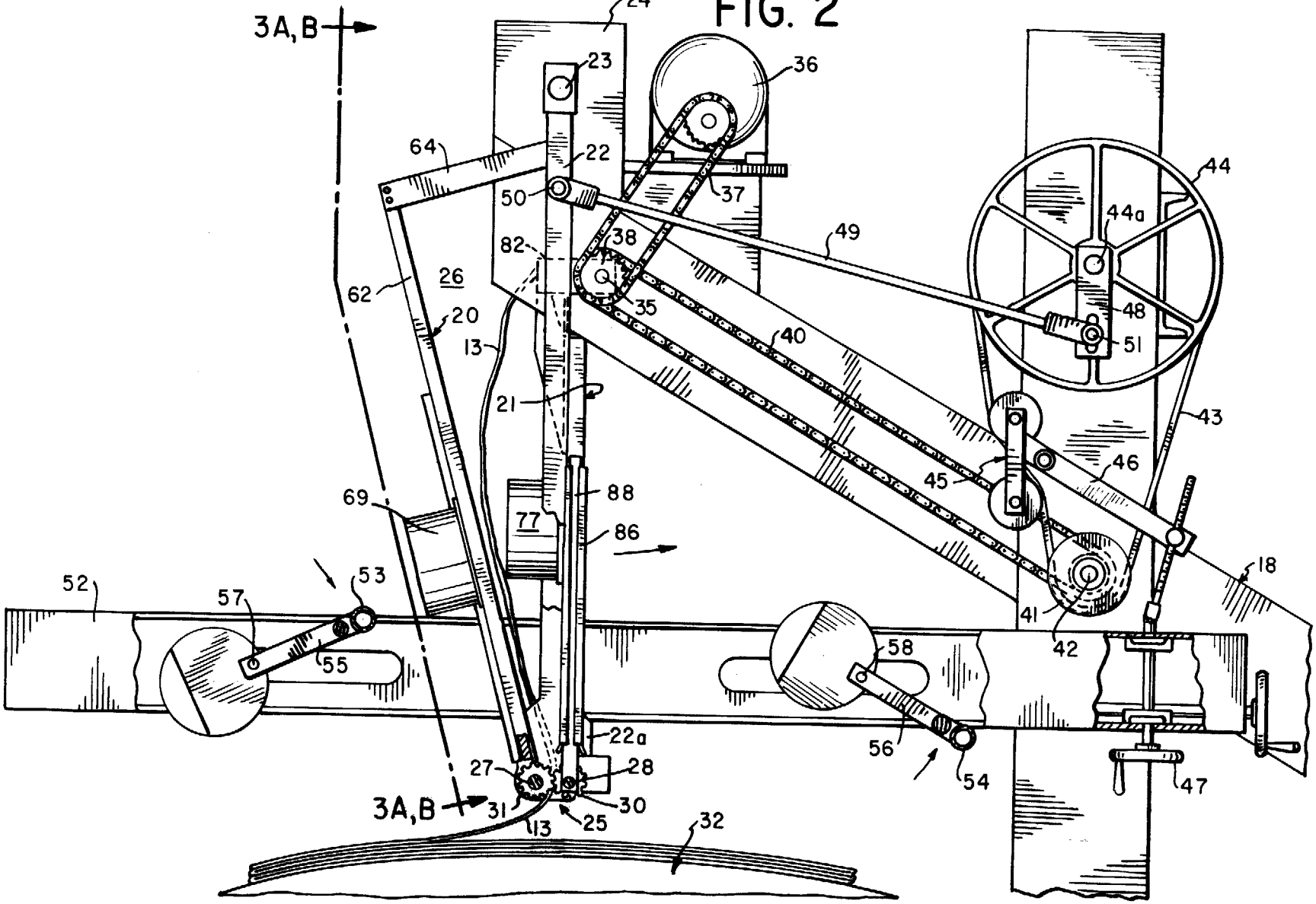
FIG. 2 is an enlarged, fragmentary view of the folder apparatus of FIG. 1, illustrating details of the construction and operation of the folding guide.

Mounted above the folding platform 32, by means of spaced structural beams 52 are counterweighted padding bars 53, 54 carried by padding arms 55, 56 and rotatable about axes 57, 58 respectively. The padding arms 55, 56 are arranged to rotate clockwise and counterclockwise respectively, as viewed in FIG. 2, such that the padding bars 53, 54, when moving in a generally downward direction over the folding platform 32, move in a generally inward-to-outward direction. The cyclical rotation of the padding bars 53, 54 is timed with the oscillations of the folding guide 26 such that the bars 53, 54 pad down the fabric edges, after the folding guide has reversed direction and is traveling away from the padding bar. This serves to flatten down somewhat the ends of the stack. To advantage, the padding arms 55, 56 are adjustable with respect to the front and back edges of the folded fabric stack, so as to accommodate different fabric characteristics as well as different amplitude adjustments of the folding guide. The drive means for the padding arms, which is not specifically illustrated, desirably includes automatic overload disconnect clutches, which can operate in the event that a malfunction in platform adjustment causes the padding bars to press downward too forcefully upon the fabric stack.

In accordance with a significant aspect of the invention, the guide panel assemblies 20, 21, incorporated in the folding guide 26, are constructed to provide air permeable surfaces across the full width of the fabric. The panel assembly 20 is suspended by its side edges, by means of structural elements 61, 62 carried by a horizontal cross bar 60. The cross bar 60 is in turn engaged at its ends by brackets 63, 64 extending from the pivoted vertical arms 22. As reflected particularly in FIGS. 4A, 4B, the panel assembly 20 is of hollow construction, comprising a flat back panel 65 of imperforate construction and a front panel 66 formed with a large plurality of air discharge apertures 67. The perforate panel 66 extends over the full width of the panel assembly, being somewhat wider than the maximum width of the fabric to be accommodated in the machine. The air apertures 67 may typically be on the order of a sixteenth of inch or so in diameter, spaced on centers of around an inch or so; alternatively the panel 66 may be formed of a suitably porous material.

In a typical practical application of the invention, the hollow panel assembly 20 may mount on its back panel 65 a pair of low pressure air blowers 68, 69. These blowers are arranged to draw air into the hollow interior 70 of the panel assembly, directing it against internal baffles 71, 72. When the equipment is in operation, the hollow interior chamber is maintained under a pressure slightly above ambient, causing a general, low pressure, low velocity flow of air out through the aperture 67 over the entire surface of the front panel 66.

The panel assembly 21 comprises front and back flat panels 73, 74, with the front panel being of perforate construction provided with a series of apertures 75 over its entire effective surface area. Blowers 76, 77 direct air under low pressure into the hollow interior 78 of the panel assembly 21, to provide for a low velocity, low pressure discharge of air from the aperture 75 toward the fabric 13. In the illustrated arrangement, in order to provide for a more compact arrangement of the folding guide, panel assemblies 20, 21 with respect to the slat conveyor 18, the blowers 76, 77 for the panel 21 are mounted on lateral extensions 79, 80 of the panel assembly 21.

It will be understood, of course, that the top, bottom and sides of the panel assemblies 20, 21 are closed, so that the interiors of the panels may be slightly pressurized to achieve the desired air flow through the front panels 66, 73.

To advantage, the discharge rollers 27, 28 are suspended for pivoting movement about a long radius, so that the arc described by the rollers, during a normal excursion, has a relatively limited vertical amplitude. To this end, the shaft 23, on which the swing arms 22 are pivoted, is located high in the machine frame, well above the discharge end of the slat conveyor 18 (see FIG. 2). At the same time, it is desired that the inner guide panel assembly 21 be pivoted about an axis coincident with or at least close to the axis of the shaft 35 which supports the slat conveyor at its discharge end. Thus, in the illustrated arrangement, the inner panel assembly 21 is pivoted on brackets 81, 82 carried by the shaft 35. The brackets 81, 82 extend downward from the shaft and are secured at 83, 84 to the side edge extremities of the inner panel assembly 21.

Inasmuch as the inner panel assembly 21 swings about a different axis (35) than the outer panel assembly 21 (shaft 23) provision is made for slidably joining the lower end of the panel assembly 21 to the discharge rollers 27, 28, in order to maintain the panel assemblies in the desired converging relationship to the discharge rollers. To this end, guide channels 85, 86 are provided along the side edges of the panel extensions 79, 80 for the slideable reception of guide bars 87, 88. The guide bar 88, at one side of the machine, includes a bearing portion 89 (FIG. 4B) which is supported directly on an extension 90 of discharge roller 27. The guide bar 87, at the opposite side, is connected to a U-shaped bracket 91 (FIG. 4A) one leg 92 of which is connected to an extension 93 of the discharge roller 28. The guide bars 87, 88 thus serve to maintain the lower of that panel assembly in alignment with the discharge roller 28, even though the spacing between the rollers and said lower edge will vary, as the rollers swing on an arc about the shaft 23 while the panel assembly 21 swings on an arc about the shaft 35.

In the operation of the apparatus of the invention, fabric web 13 is discharged at high speed from the end of the slat conveyor 18, dropping downward into the converging passage formed between the guide panel assemblies 20, 21. By appropriate adjustment of the connecting rod 49 and speed control 46, 47, the discharge rollers 27, 28 of the folding guide are caused to oscillate back and forth at a speed corresponding to the rate of discharge of the fabric. As the fabric passes downward through the folding guide, cushions of air are continuously discharged from the apertured panels 66, 75, directed toward broad surfaces of the fabric web, tending to keep the web out of contact with the guide panels. Thus, even though the folding guide is being oscillated at a relatively high rate of speed, continually changing direction and accelerating, and tending to "plaster" the descending fabric web against one or the other of the panel assemblies 20, 21, the continuously discharging air flow effectively cushions this action, substantially preventing actual contact and greatly minimizing the effect of any that does occur. As a result, the fabric is permitted to fall freely by gravity through the folding guide, without irregular frictional restraint from the folding guide itself. This has enabled the fabric to be handled in the folding guide at much higher speeds than has been practical heretofore.

The new method and apparatus for high speed folding of fabric webs provides an optimum adjunct to the high speed steaming and calendering equipment of the beforementioned Frezza patents.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. Apparatus for folding fabric at high speed, which comprises a. a receiving platform, b. a fabric folding guide mounted for back and forth oscillating movement above said platform, c. said folding guide comprising a pair of opposed, downwardly extending guide panels for directing the fabric in a back and forth direction during the oscillation of the following guide, d. opposing faces of said guide panels being of air permeable construction across their entire working widths, e. means for directing fabric web downward between the opposed guide panels, and f. means for maintaining a continuous flow of air through the permeable guide panels and toward the opposite surfaces of the fabric web.

2. Apparatus according to claim 1, further characterized by a. said guide panels each comprising spaced front and back panels, b. said front panels having spaced air discharge apertures disposed over the entire effective working areas of panels.

3. Apparatus according to claim 1, further characterized by a. conveyor means having a discharge end for discharging fabric web into said folding guide, b. one of said guide panels being mounted for pivoting movement about a first axis near the discharge end of said conveyor means, and c. the other of said guide panels being mounted for pivoting movement about a second axis spaced substantially above the first axis and farther removed from said conveyor means than said one guide panel.

4. Apparatus according to claim 1, further characterized by a. said folding guide having a top and a bottom, b. a pair of oppositely rotating discharge rolls at the bottom of said folding guide, and c. said guide panels being relatively widely separated at the top of said folding guide and converging toward the bottom thereof.

5. Apparatus according to claim 1, further characterized by a. said guide panels being of hollow, flat construction, b. blower means connected to said guide panels for maintaining the hollow interiors thereof at higher than ambient pressure.

6. The method of folding a continuously moving fabric web at high speed in a folder of the type having a pair of oscillating panel-type folding guides, which comprises a. conveying the web to the folding area, b. discontinuing the conveying of the web and discharging the web freely into the folding guide.

c. oscillating the folding guide in a back and forth manner while causing and permitting the fabric web to be discharged from the folding guide, and d. while the web is in said folding guide continuously directing air toward the opposite surfaces of the web from opposite sides thereof and over substantially the entire area of the web which is at any time within the reciprocating folding guide to limit or prevent contact of the web with areas of said folding guide confronting said fabric web.

7. The method of claim 6 wherein said folding guide includes opposed, downwardly converging guide panels for guiding and controlling downward movement of the fabric web, further characterized by a. said air being directed through the surfaces of the respective guide panels over substantially the entire effective working area of said panels.

* * * * *